US009835291B2

(12) United States Patent
Blanchard et al.

(10) Patent No.: US 9,835,291 B2
(45) Date of Patent: Dec. 5, 2017

(54) CONNECTION FOR REFRIGERATED GAS STORAGE TANK

(71) Applicant: Chicago Bridge & Iron Company, Plainfield, IL (US)

(72) Inventors: John M. Blanchard, Bolingbrook, IL (US); Mark Butts, Plainfield, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 0 days.

(21) Appl. No.: 15/061,289

(22) Filed: Mar. 4, 2016

(65) Prior Publication Data

US 2016/0258577 A1 Sep. 8, 2016

Related U.S. Application Data

(60) Provisional application No. 62/128,743, filed on Mar. 5, 2015.

(51) Int. Cl.
*F17C 3/04* (2006.01)
*F17C 13/00* (2006.01)
*F17C 3/02* (2006.01)

(52) U.S. Cl.
CPC ..... *F17C 3/04* (2013.01); *F17C 3/022* (2013.01); *F17C 13/004* (2013.01);
(Continued)

(58) Field of Classification Search
CPC ..... B65D 11/08; B65D 25/005; B65D 51/16; F17C 3/04; F17C 3/022; F17C 13/004; F17C 13/001
(Continued)

(56) References Cited

U.S. PATENT DOCUMENTS 2,530,706 A 11/1950 Lange
3,407,616 A * 10/1968 Freeman, Jr. ..... F17C 7/04 62/50.2
(Continued)

FOREIGN PATENT DOCUMENTS

CN 103477173 A 12/2013
DE 102011006802 A1 10/2012
(Continued)

OTHER PUBLICATIONS

Long, Bob et al., "Guide to Storage Tanks & Equipment," Professional Engineering Publishing, 2004, p. 393-395 (4 pages).
(Continued)

*Primary Examiner* — Robert J Hicks
(74) *Attorney, Agent, or Firm* — Osha Liang LLP

(57) ABSTRACT

A storage tank includes a tank roof and a tank sidewall. At least one opening is located in at least one of the tank roof or the tank sidewall. A pipe extends through the at least one opening, the pipe having a sleeve assembly positioned around the pipe. The sleeve assembly also extends through the opening. The sleeve assembly includes a sleeve, at least one layer of insulation, and an inner flange. The inner flange is located on a first end of the sleeve and is coupled to the pipe. The sleeve, in turn is coupled to the tank such that the inner flange is located within the storage tank. The at least one layer of insulation is positioned in an annulus between the pipe and the sleeve.

12 Claims, 4 Drawing Sheets

(52) U.S. Cl.
CPC .. *F17C 2203/03* (2013.01); *F17C 2203/0629* (2013.01); *F17C 2205/0355* (2013.01); *F17C 2209/22* (2013.01); *F17C 2223/0161* (2013.01); *F17C 2223/033* (2013.01); *F17C 2223/047* (2013.01); *F17C 2260/02* (2013.01); *F17C 2260/033* (2013.01); *F17C 2270/01* (2013.01); *F17C 2270/0134* (2013.01)

(58) Field of Classification Search
USPC ..... 220/601, 367.1, 661, 560.12, 560.04
See application file for complete search history.

(56) References Cited

U.S. PATENT DOCUMENTS 3,536,028 A * 10/1970 Adaglio ..... F16K 1/305 116/109
3,728,187 A * 4/1973 Martin ..... B29C 53/66 138/144
4,461,399 A * 7/1984 Sattelberg ..... F17C 13/001 220/565
4,582,221 A 4/1986 Lamb et al.
4,865,220 A 9/1989 Wiegand
8,240,344 B2 8/2012 Graham et al.
2007/0074778 A1 4/2007 Berti et al.
2010/0032051 A1 2/2010 Graham et al.

FOREIGN PATENT DOCUMENTS

EP 2592269 A1 5/2013
GB 928375 A * 6/1963 ..... B65D 11/08

OTHER PUBLICATIONS

International Search Report and Written Opinion issued in International Application No. PCT/US2016/020946; dated Jun. 10, 2016 (16 pages).

* cited by examiner

CONNECTION FOR REFRIGERATED GAS STORAGE TANK

BACKGROUND

Tanks that store liquefied gasses maintained at a temperature substantially below ambient or atmospheric temperatures and at relatively low pressures are insulated to maintain the fluid at the desired temperature and/or pressure. For example, tanks which store liquefied gasses at a low temperature and pressure are insulated to reduce the liquid to gas phase transformation within the tank to a low level. Referring to FIG. 1, an example of a cryogenic tank 10 is shown. The tank 10 includes a primary liquid container 1, which holds the fluid, and a secondary liquid container 2 located around the primary liquid container 1. Tank insulation 6, 8, is located between the primary liquid container and the secondary liquid container. The tank 10 also includes a roof 3 located above the stored liquid and separated from the liquid by an insulated second roof 5 that may be suspended from the first roof 3. The space 7, or warm vapor space 7, between the roofs (i.e., between roof 3 and insulated second roof 5) or between the roof 3 and secondary liquid container 2 contains warm (relative to the stored liquid) product vapors and allows the first roof 3 to remain near ambient temperature.

Process pipe 12 carrying fluids e.g., liquefied gas and cold vapor, to and from the primary liquid container protrudes from an opening in the roof 3 or a sidewall of secondary liquid container 2 of the storage tank 10. The process pipe 12 may be one continuous pipe, or may include a number of pipe segments. The connection into the secondary container 2 or roof 3 must maintain the structural and thermal integrity of the tank 10. In order to maintain proper temperature requirements of the warm first roof 3, a pressure containing connection 20 is located at the opening and positioned around the cold process pipe 12 located in the opening. This connection 20 completes the container pressure boundary, accommodates piping loads to the tank 10, acts as a vapor barrier for the insulation, and transfers the thermal gradient between the cold pipe and the warm container 2. The section of the connection where the thermal gradient occurs is referred to as the thermal distance piece (TDP).

Referring to FIG. 2, an example of a prior art TDP assembly 20 is shown. Conventionally, a portion of the TDP 20 is exposed to ambient conditions outside tank roof 3 to provide beat to the TDP 20. The TDP 20 includes a sleeve 23 positioned around a portion of the process pipe 12 located within an opening 31 of the tank roof 3. The sleeve 23 includes an annular top plate 24 welded to a top end of the sleeve 23. An inner circumferential surface of the annular top plate 24 is welded to an outer circumferential surface of the process pipe 12 to connect the sleeve 23 to the process pipe 12. The sleeve 23 is welded to the tank roof 3. Welding the sleeve 23 to the tank roof 3 creates a direct load transfer between the TDP 20 (including the process pipe 12) and the tank roof 3. Additionally, the welded connection between the sleeve 23 and tank roof 3, the welded connection between the top plate 24 and sleeve 23, and the welded connection between the top plate 24 and process pipe 12 create a vapor tight connection and prevents vapors located in the tank from exiting the tank and ambient moisture outside the tank from entering the TDP 20 and the tank 10.

Insulation 21, e.g., granular insulation, fiberglass, foams, or other insulating materials known in the art, is located between the process pipe 12 and the sleeve 23. Because the sleeve 23 is welded to the roof 3 at the tank site, insulation is usually installed after the sleeve 23 is welded to the roof 3, as most insulation materials are sensitive to high temperatures. Those assemblies that occasionally did install the insulation material in the shop were well known in the industry of having shorter industrial lifespans due to thermal insulation cracking. Were the insulation 21 installed prior to welding the sleeve 23 to the tank roof 3, the high heat of the welding process would cause portions of the insulation 21 to melt and/or create voids within the insulation 21. Any voids in the insulation 21 make the insulation 21 less effective and allow frost to form along an outer diameter of the sleeve 23 proximate the location of the void.

Continuing with the above example of prior art, the insulation 21 is installed through a plurality of circular openings 25 in the top plate 24 or a plurality of openings 26 in the sleeve 23. Conventionally, a blower or jet pump provides positive pressure to blow insulation into the annular space between the sleeve 23 and the process pipe 12. Thus, the type of insulation 21 selected to be installed should be able to be installed through openings 25. Once the insulation 21 is installed, the openings 25 are sealed. Because the openings 25, 26 to the insulation 21 are readily accessible, in the event that the insulation 21 fails, a worker is able to reinstall and/or repair insulation 21 without removing the entire TDP assembly from the tank roof 3.

However, the direct contact between the top plate 24 and the process pipe 12 conducts heat away from the upper end of sleeve 23, reducing the temperature of the upper end of the sleeve 23 significantly. The exposure of the top plate 24 and areas of the sleeve 23 proximate the top plate 24 to moisture in the atmosphere can cause condensation and ice to form around the TDP 20, which reduces the efficiency of the TDP, adds to the required maintenance of the area around the TDP 20, impedes access to the TDP 20, and creates a potential safety hazard. Accordingly, there is a need for a TDP assembly that reduces and/or eliminates the formation of ice on the TDP.

SUMMARY

In one aspect, embodiments disclosed herein relate to a storage tank comprising a tank roof, a tank sidewall, an opening in at least one of the tank roof or the tank sidewall, and a pipe extending through the at least one opening. A sleeve assembly may also be included such that the sleeve assembly is disposed around the pipe and extends through the at least one opening. The sleeve assembly includes a sleeve coupled to the storage tank, at least one layer of insulation disposed in an annulus between the pipe and the sleeve, a vapor barrier for the insulation to protect it from the atmosphere outside of the storage tank, wherein such vapor barrier may or may not be the uppermost part of the above mentioned insulation, and wherein such vapor barrier should (i) be able to withstand the thermal gradient between the pipe and the sleeve (which is nominally at outside ambient temperature) without losing its vapor barrier integrity and (ii) must have a thermal conductivity far less than metals at 25 C (which usually run between 30 to 300 W/(m·K) at 25 C), preferably less than 0.5 W/(m·K) at 25 C (the thermal conductivity of glass and high density polyethylene), more preferably less than 0.3 W/(m·K) (the thermal conductivity of epoxy and silicone resins, several low density woods and many non-foamed polymers) at 25 C and most preferably less than 0.15 W/(m·K) (the upper end of thermal conductivity for most polymer foams) and an inner flange disposed on a first end of the sleeve and coupled to the pipe, the inner flange disposed within the storage tank.

In another aspect, embodiments disclosed herein relate to an assembly comprising a section of pipe and a sleeve having a first end and a second end disposed around the section of pipe. The assembly includes an annular flange disposed at the first end of the sleeve extending radially inward and engages an outer surface of the section of pipe. The assembly also includes a first layer of insulation is disposed along an inner surface of the sleeve extending from near the flange toward the second end of the sleeve and a vapor barrier between the insulation and the outside atmospheric conditions. The assembly is configured such that the annular flange and any insulation adjacent the annular flange is not exposed to ambient conditions once installed in a tank.

In another aspect, embodiments disclosed herein relate to an assembly comprising a sleeve having a first end and a second end. An annular flange is disposed at the first end of the sleeve extending radially inward. A first layer of insulation is disposed along an inner surface of the sleeve extending from near the flange toward the second end of the sleeve. A vapor barrier between the insulation and the outside atmospheric conditions. The assembly is configured such that the annular flange and any insulation adjacent the annular flange is not exposed to ambient conditions once installed in a tank.

In another aspect, embodiments disclosed herein relate to a method comprising forming a thermal distance piece having an annular flange on a first end of a sleeve. Next, a first layer of insulation is installed along a length of the sleeve, between the flange to a second end of the sleeve. After installing the first layer of insulation the thermal distance piece is installed on a tank.

In another aspect, embodiments disclosed herein relate to a method of installing a thermal distance piece into a tank comprising sliding a pipe having a thermal distance piece disposed thereon into an opening of a tank. The thermal distance piece is positioned in the opening of the tank, such that at least a portion of the thermal distance piece is disposed inside the tank, wherein a connection of the sleeve to the pipe is located inside the tank. Once in place a sleeve of the thermal distance piece is connected to the tank This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Generally, embodiments disclosed herein relate to an assembly to be used with a storage tank. The assembly is a thermal distance piece (TDP) assembly. More specifically, the present disclosure relates to a storage tank utilizing a thermal distance piece assembly, and methods for manufacturing and installing a thermal distance piece assembly. A TDP configuration or TDP assembly in accordance with embodiments disclosed herein eliminates and/or reduces the formation of ice and condensation on the TDP, allows prefabrication including insulation, and allows a quicker and more efficient installation of the TDP at a storage tank site. As used herein, the terms "TDP," "TDP assembly," and "the assembly" may be used interchangeably to refer to the TDP component of the tank.

Figure 3B:
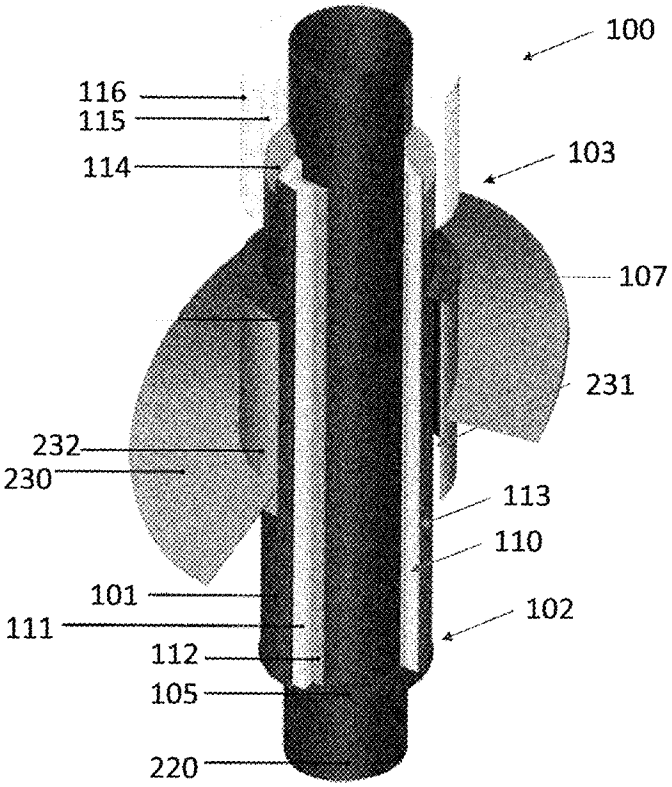
FIGS. 3A and 3B are perspective views of thermal distance piece assemblies in accordance with embodiments of the present disclosure.
Figure 3A:
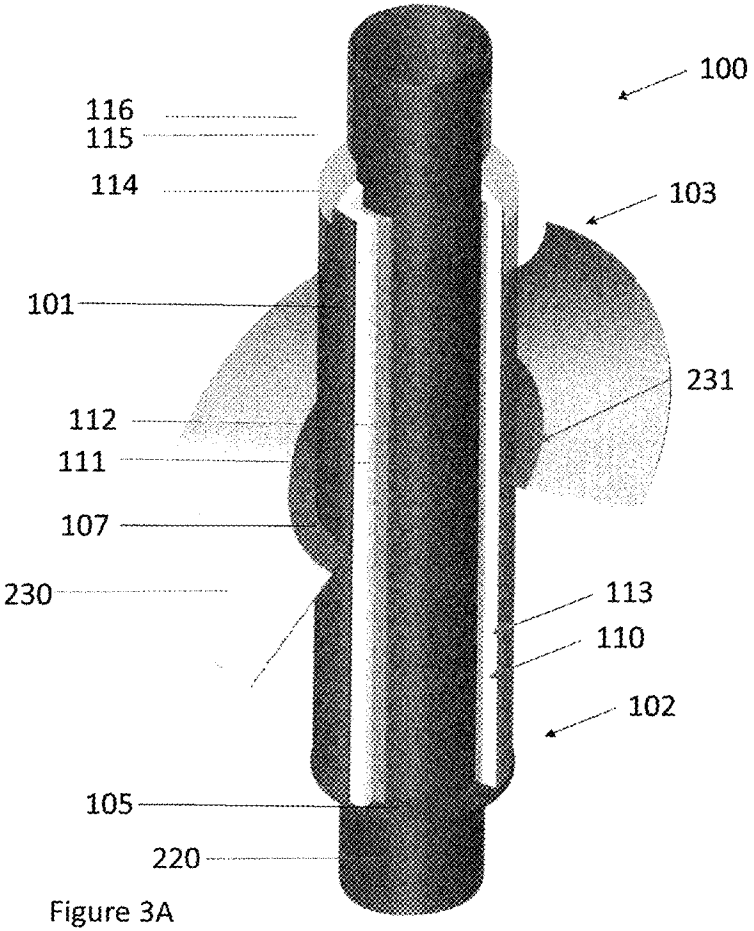

Referring initially to FIGS. 3A and/or 3B, a perspective view of a TDP assembly 100 disposed on a tank pipe 220 and a portion of a tank roof 230 is shown. The TDP 100 forms a connection between tank pipe 220 and the tank roof 230. Specifically, FIG. 3A shows an assembly 100 directly coupled to tank roof 230. FIG. 3B shows an assembly 100 attached to a connector sleeve 232 of the tank roof 230. The assembly 100 includes at least a sleeve 101, an inner flange 105, insulation 110, and a vapor barrier layer 114. In some embodiments, the assembly 100 may or may not include at least a portion of pipe 220. The sleeve 101 has at least a first end 102 and a second end 103. The first end 102 corresponds to a lower end of the sleeve 101 and the second end 103 corresponds to an upper end of the sleeve 101.

The inner flange 105 is located at the first end 102 of the sleeve 101. The inner flange 105 extends radially inward from the sleeve 101. An inner diameter of the inner flange 105 is sized depending on an outer diameter of tank pipe 220, as the inner flange 105 is provided to couple the sleeve 101 to the pipe 220. That is, an inner diameter of the inner flange 105 is sized to fit around the outer diameter of the tank pipe 220. The inner flange 105 is attached to the tank pipe 220 by, for example, welding or mechanical fastening means, e.g., bolts, screws, and rivets, as known in the art.

Insulation 110 is located in the annulus 113 between the sleeve 101 and the process pipe 220. At least one layer of insulation 110 is located in this annulus 113. As shown in, for example, FIGS. 3A and 3B, the insulation 110 includes two layers, a first layer 111 and a second layer 112 with the appropriate characteristics, e.g., a foam layer of insulation and an insulation blanket. The at least two layers of insulation with the appropriate characteristics allows the pipe 220 to shrink and expand (e.g., thermally contract and expand) without causing damage to the insulation, i.e., cracking, the insulation layers. One of ordinary skill in the art will appreciate various combinations of materials having various characteristics may be selected to provide expansion and contraction without cracking or damaging the insulation. Any voids in the insulation 110 caused by, for example, cracking, reduces the effectiveness of the insulation 110 and allows frost to form along an outer diameter of the sleeve 101 proximate a location of the void. The layers of insulation 110 may be arranged concentrically. However, the number of layers and the relative orientation, i.e., concentric and/or vertical (e.g., stacked), of the layers of insulation 110 are not intended to limit the scope of the present disclosure.

The insulation material located in the annulus 113 may be, for example but not limited to, foam insulation, insulation blanket, granular insulation, and other insulation materials known in the art. In embodiments having at least two layers of insulation, the two layers of insulation 111, 112 may be the same or different types of insulation materials. For example, the first layer of insulation 111 may be a foam insulation and the second layer 112 may be an insulation blanket.

At the first end 102 of the sleeve 101, the inner flange 105 acts as a barrier to isolate the insulation 110 and annulus 113 from surrounding conditions (i.e., warm product vapor inside the tank). At the second end 103 of the sleeve 101, a primary vapor barrier layer 114 extends from an outer diameter of the sleeve 101 to the pipe 220 to prevent outer conditions (i.e., ambient and/or atmospheric conditions) from entering the annulus 113 and insulation 110. Unlike prior art embodiments, which rely on welds and a top plate (24 in FIG. 2) to provide a vapor tight barrier between ambient conditions and TDP insulation (21 in FIG. 2), the primary vapor barrier 114 isolates the insulation 110 and annulus 113 from ambient conditions. As used herein, the term "vapor barrier layer" refers to a material layer that prevents ambient moisture from passing therethrough. Specifically, primary vapor barrier 114 prevents ambient moisture from entering the annulus 113 and diffusing throughout the insulation 110, without providing a thermally conductive path between the pipe 220 and the second end of sleeve 101.

The primary vapor barrier layer 114 is formed from, for example, but not limited to coatings, plastic, and foils, which have a low thermal conductivity, and are suitable for the temperature range between ambient and the temperature of the pipe 220. The primary vapor barrier layer 114 is coupled to the assembly 100 by adhesion or mechanical fastening means, e.g., bolts, screws, rivets, etc., known in the art.

Still referring to FIGS. 3A and/or 3B, additional pipe insulation 115 and a secondary barrier layer 116 are positioned over the second end 103 and primary vapor barrier layer 114. The pipe insulation 115 is located on an outer circumference of the pipe 220 and/or a pipe segment adjacent to pipe 220. The pipe insulation 115 extends from a second end 103 of the pipe 220 radially outward of the primary vapor layer and upward along pipe 220. The secondary vapor barrier layer 116 is positioned on a surface of the pipe insulation 115 and provides a secondary vapor barrier to prevent moisture from entering annulus 113. The secondary barrier layer 116 can be positioned on an outer surface of the pipe insulation 115 extending over the primary vapor barrier 114 and joining onto the outer surface of sleeve 101. Secondary vapor barrier 116 may be adjoined to sleeve 101 by adhesion or mechanical means. Although FIGS. 3A and/or 3B illustrate secondary vapor barrier layer 116, a TDP assembly 100 in accordance with embodiments of the present disclosure may be practiced with just primary vapor barrier 114.

In the embodiment illustrated in FIGS. 3A and 3B, the sleeve 101 includes an outer flange 107 coupled to the assembly 100. The outer flange 107 is an annular flange located along an outer perimeter of the sleeve 101 extending radially outward from the sleeve 101. The outer part of flange 107 connects the assembly 100 to the tank roof 230. For example, the outer flange 107 may be welded to the tank roof 230, as shown in FIG. 3A. In such embodiments, moving a location of the weld away from the sleeve 101 and insulation (e.g., 110, 111, and 112) allows welding to be performed without risk of melting and/or otherwise damaging the insulation. The outer flange 107 transfers pressure and mechanical loads between the tank roof 230 and the assembly 100 including pipe 220. One skilled in the art will understand that other attachment means known in the art for transferring loads may be used to connect the outer flange 107 to the tank roof 230, for example, bolts, rivets, screws, etc.

Referring to FIGS. 3A, 3B, 4, and 5 collectively, a TDP assembly in accordance with embodiments described herein is installed on a cryogenic storage tank, for example, tank 400 (FIG. 4) having a low temperature steel roof 230 and/or tank 500 (FIG. 5) having a low temperature steel and concrete roof 530. The configuration of tank and/or tank roof is not intended to limit the scope of the present disclosure. Although the TDP assembly 100 of FIGS. 3A and 3B is shown with respect to installation through a tank roof 230, one skilled in the art would understand that TDP assemblies according to embodiments disclosed herein can be installed through any surface of a tank 400 exposed to the environment, for example, sidewalls of vapor container 202.

Figure 4:
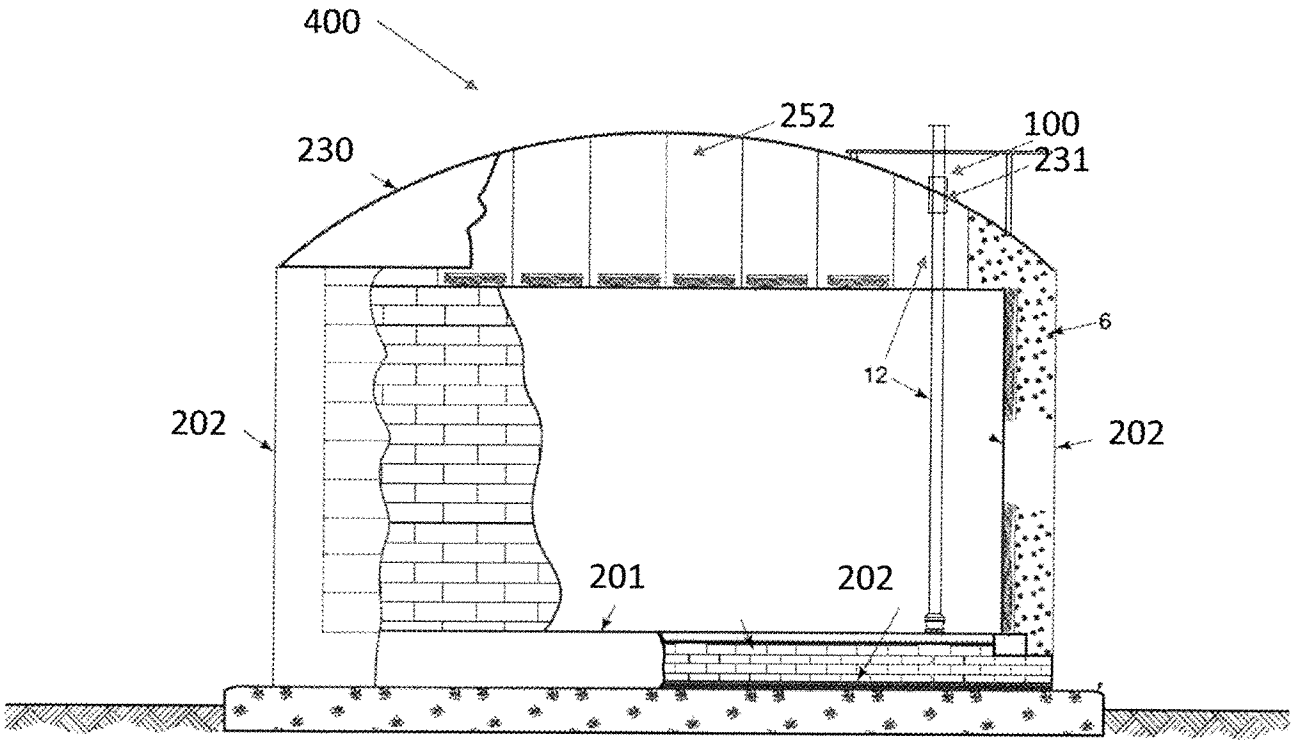
FIGS. 4 and 5 show partial cross-sectional views of storage tanks in accordance with embodiments of the present disclosure.

Referring to FIGS. 3B and 4, in some embodiments, the tank roof 230 includes a connector sleeve 232 located along an outer perimeter of an opening 231 of tank roof 230 through which the pipe 220 and assembly 100 are located. The connector sleeve 232 may be welded to the roof, although other connection means known in the art may be used to couple the connector sleeve 232 to the roof 230. Connector sleeve 232 extends through the roof as shown in FIG. 3B. In some embodiments, the connector sleeve 232 may extend to the roof 230 with no extension below the roofline. As noted above, the sleeve 101 may include an outer flange 107 located on an outer diametrical surface of the sleeve 101 between the first end 102 and the second end 103. The outer flange 107 is used to connect the assembly 100 to the roof connector sleeve 232. For example, in some embodiments, the outer flange 107 may be welded to the connector sleeve 232. This connection helps to transfer the pressure and mechanical loads of the pipe 220 and/or assembly 100 to the tank roof 230.

Figure 5:
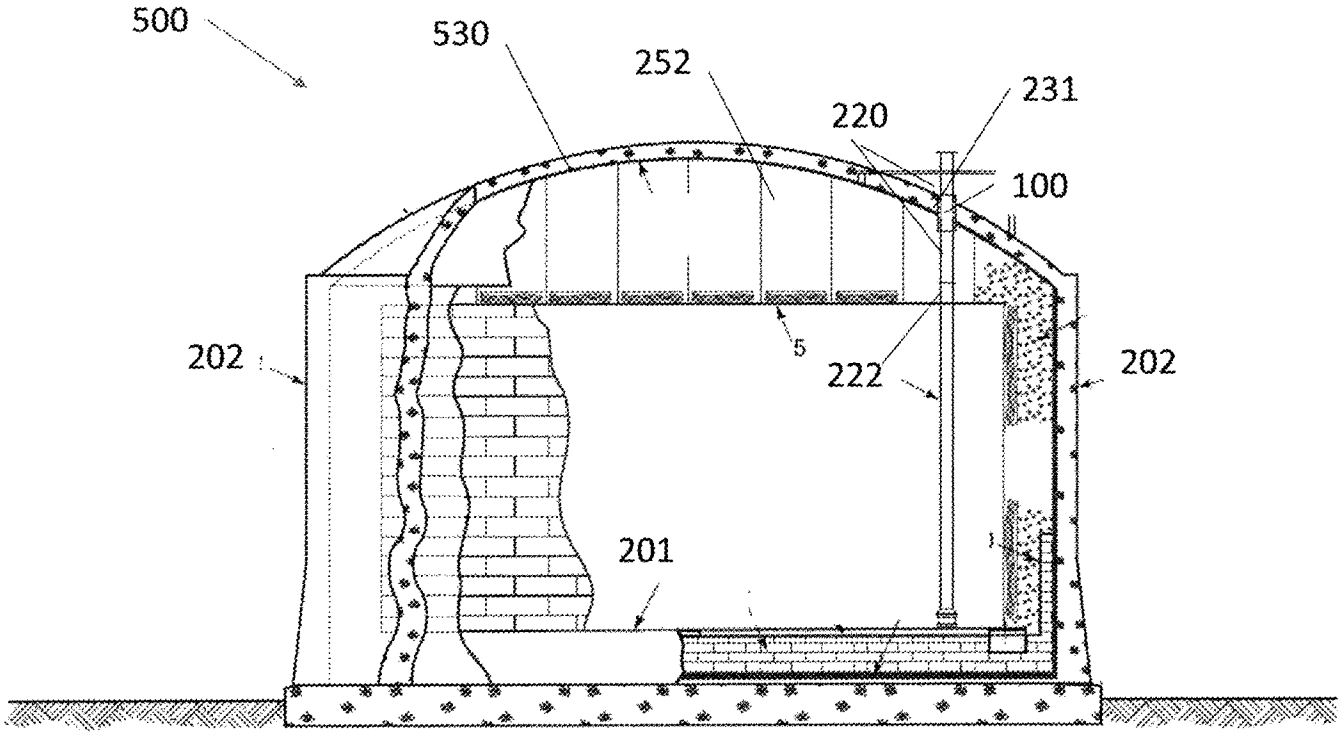

Referring to FIG. 4, the pipe 220 may extend from outside the tank 400 through the roof 230, through the warm vapor space 252, and into the primary liquid container 201. Referring to FIG. 5, in other embodiments the pipe 220 extends through the roof 530 into the warm vapor space 252 and is connected to a second pipe segment 222, such that the second pipe segment 222 extends from the warm vapor space 252 into the primary liquid container 201.

Referring to FIG. 3A or 3B, and 4, the connection of the sleeve 101 to the pipe 220 with inner flange 105 is located below the roof 230 of the tank 400, in the warm vapor space 252 of the storage tank 400. The inner flange 105 may be coupled to the pipe 220 using any coupling means known in the art, for example, but not limited to, welds, bolts, rivets, screws, etc. Positioning the inner flange 105 in the storage tank 200, exposes the inner flange 105 to product vapors, e.g., vapors from a liquefied gas, and not ambient atmospheric conditions. Under some conditions, the product vapors may condense against sleeve 101 within the warm vapor space 252 but will not reach a corresponding freezing point. Other portions of the sleeve 101, for example, the second end 103 of the sleeve 101, are not directly coupled to the pipe 220. The configuration of the assembly 100 described herein prevents and/or reduces ice formation on any part of the assembly 100 by placing the inner flange 105 within the vapor space 252 sufficiently below the opening 231. For example, when the inner flange 105 is sufficiently below the opening 231, adequate heat input (or cold dissipation) in the part of the sleeve 101 located below the roof 230 may occur, which aids in avoiding ice formation on a portion of the sleeve 101 exposed to atmospheric conditions. Optimally, a "sufficient distance" is approximately 12 inches are more; however, a lesser distance could be made to work with less efficient results. Without a direct coupling between the pipe 220 and the sleeve 101 along the portion of the sleeve exposed to atmospheric conditions, ice formation against the assembly 100, e.g., sleeve 101, will be reduced and/or eliminated.

The TDP assembly 100 is assembled by connecting the annular inner flange 105 to the sleeve 101. The annular inner flange 105 may be connected to the sleeve 101 by, for example, welding, or mechanical means. In some embodiments, an outer flange 107 is installed on the sleeve 101 between the first end 102 and the second end 103. The outer flange 107 is installed using similar methods as those described above with respect to inner flange 105. Once the sleeve 101 is attached to at least an annular inner flange 105 the sleeve 101 is positioned on pipe 220. The annular inner flange 105 is then connected, e.g., welded, to the pipe 220, such that an annulus 113 is formed between the pipe 220 and the sleeve 101.

Insulation 110 is then installed in the annulus 113 formed by the pipe 220 and the sleeve 101. The insulation is at least one selected from, foam insulation, blanket insulation, etc. For example, a foam insulation may be installed along a length of the sleeve 101 from a first end 102 to a second end 103. A top surface profile of the insulation 110 may be flush with a top surface of the second end 103 of the sleeve 101. In some embodiments, a top surface profile of the insulation 110 may be substantially non-planar, e.g., conical, parabolic, hyper-parabolic, ovoid, etc.

In some embodiments, at least two layers 111, 112 of insulation are installed. For example, an inner layer of blanket insulation 112 is positioned around a portion of pipe 220 within the annulus 113. Foam insulation 111 is then injected into the remaining annular space 113 between the inner layer of blanket insulation 112 and the sleeve 101. While the foam insulation 111 sets, the foam expands to create a vapor tight insulative space between the sleeve 101 and the inner layer of blanket insulation 112. The expansion of the foam also exerts a compressive force on the blanket 112, which compresses the blanket 112 against pipe 220. One skilled in the art will understand that other methods of installing insulation in the annulus 113 may be used without departing from the scope of the present disclosure.

A TDP assembly 100 in accordance with embodiments of the present disclosure is preassembled as described above such that the TDP assembly 100 is insulated, prior to being installed on the tank 400. The preassembled TDP assembly 100 is installed on a storage tank, for example, tank 400 by sliding the TDP assembly 100 through an opening 231 of the roof 230 and into the secondary vapor container 202. In some embodiments the pipe 220 may extend into the warm vapor space 252 of tank 400 and connect, i.e., weld, threadably engage, and/or be mechanically fastened to a pipe segment extending into the primary liquid container 201. In tanks having a connector sleeve 232, the TDP assembly 100 is positioned within the connector sleeve 232. Although described with respect to storage tank 400 the TDP assembly 100 may be installed on a variety of storage tank configurations, for example storage tank 500 shown in FIG. 5. The types of tanks provided in the Figures are not intended to limit the scope of the present disclosure.

Once the TDP assembly 100 and pipe 220 are in place, the assembly 100 may be welded, or otherwise attached, to the roof 230 of a tank. For example, an outer flange 107 of sleeve 101 of the TDP assembly can be welded to the roof 230 and/or a connector sleeve 232 of the roof 230. One skilled in the art will understand that installation of TDP assemblies in accordance with embodiments disclosed herein is not limited to tank roofs. For example, in tanks having a process pipe 220 that penetrates a sidewall, e.g., wall 202 of FIG. 4, the TDP assembly 100 may be positioned within an opening of the sidewall 202 to provide a pressure and vapor barrier for the tank.

The second end 103 can be coated with a primary barrier layer 114 to seal the insulation from ambient moisture. The primary barrier layer 114 may be installed either prior to or after installing the pre-insulated TDP assembly 100 into a storage tank, e.g. tank 400 or tank 500 in FIGS. 4 and 5, respectively. In some embodiments, pipe insulation 115 may be installed above the primary vapor barrier layer 114. With the pipe insulation 115 installed, a second vapor barrier layer 116 is installed, e.g., a vapor barrier material is applied or overlaid, on and/or around an outer surface of the pipe insulation 115.

One skilled in the art will understand that other methods of installation and/or a modified order of steps may be used without departing from the scope of the present disclosure. For example, the insulation 110 may be installed prior to welding flange 105 to the pipe 220. In other embodiments, assembly 100 including the sleeve 101 and insulation 110 is initially installed on a "dummy pipe." The assembly 100 is later removed and placed on pipe 220 prior to installation in a tank.

The TDP of the current invention is a radical departure from past practice in the industry, fulfilling a long unfilled need. As noted in the publication "Guide to Storage Tanks & Equipment" by Bob Long and Bob Garner (published by Professional Engineering Publishing, 2004), "It is sometimes written in specifications that the heat breaks [the TDP] shall prevent ice formation or condensation on the tank roof local to the fitting under all atmospheric conditions. This is a quite unreasonable requirement which is impossible to comply with. There will always be some measure of cooling of the roof or the warm side components of the heat break adjacent to the fitting . . . ." (p 394).

Prior to this invention, it was believed that they only viable vapor tight barrier that would maintain its vapor-barrier integrity when (i) subjected to the low temperatures of the liquefied natural gas (LNG) and (ii) the massive thermal gradient between LNG temperature and ambient temperature would be the welded metal enclosure of the prior art. Vapor penetration into the insulation would create major damage, require taking the tank out of service for an extended period of time to correct the damage, an extremely costly proposition. For this reason, solutions other than the welded metal plate were not considered viable, but the inherent ice-formation issue remained unsolved.

At the time of the invention, there were no publically known substitutes to the welded metal top plate that would maintain their vapor-barrier integrity sufficient for such harsh conditions. However, the inventors discovered tested numerous vapor-protection barriers that were specifically not rated for such conditions. Surprisingly, the inventors found TremPro® 626 (Beachwood, Ohio), though not rated for such conditions, would provide a vapor-barrier at LNG temperatures and maintain its vapor-barrier integrity despite the thermal gradient. After the conception and reduction of practice of the invention, additional products came to market that could also be used in the same manner, such as Foster® 90-61.

Beyond not knowing any useful materials that could create a vapor barrier subject to the two above conditions, one of ordinary skill in the art at the time of the invention would have had serious concerns about using any foam product as insulation for a long narrow annulus as used in the present invention. One of the problems with many expanding foam insulators is that they would leave voids, which would lead to unacceptable insulations gaps.

While the discovery of this invention led to reducing or eliminating the ice formation along assembly 100 as described in the next few paragraphs, it also unexpectedly led to additional benefits not foreseen by the inventors. The current invention also led to the unexpected safety and economic benefits of being able to insulate the TDP assembly off site, and for the installation of the TDP on the tank roof before it is raised into place, each more fully described below.

Embodiments disclosed herein provide improved thermal performance of a TDP assembly while reducing and/or maintaining a diameter of the TDP assembly. For example, a TDP assembly in accordance with embodiments disclosed herein will eliminate ice formation along the assembly 100 except under a narrow range of atmospheric conditions. The improved thermal performance is accomplished by locating inner flange 105, which provides a direct connection between sleeve 101 and the pipe 220, in the tank below the opening 231. Without a direct coupling between the pipe 220 and the sleeve 101 along the portion of the sleeve exposed to atmospheric conditions, ice will not form against the assembly 100. In contrast, referring to the conventional TDP assembly 10 of FIG. 2, plate 24, which provides a direct connection between the outer sleeve 23 and the pipe 12, is located above the tank roof 3. The plate 24 conducts heat away from the outer sleeve 23, which leads to ice and condensation formation along sleeve 23.

Figure 2:
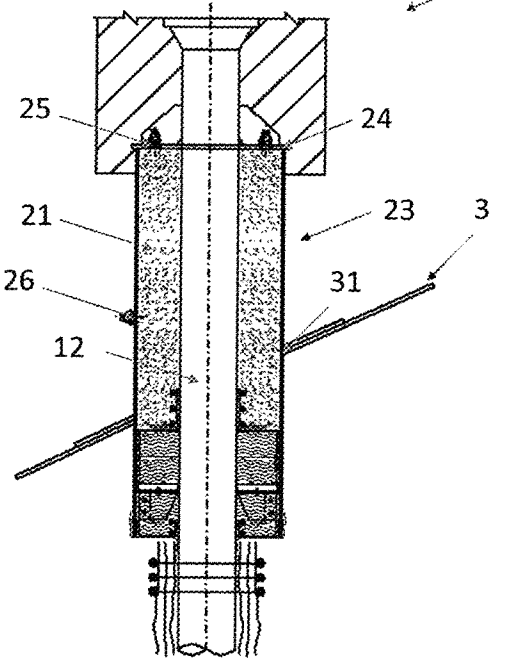
Figure 2 (Prior Art)
FIG. 2 is a cross-sectional view of a prior art thermal distance piece assembly.
Figure 1:
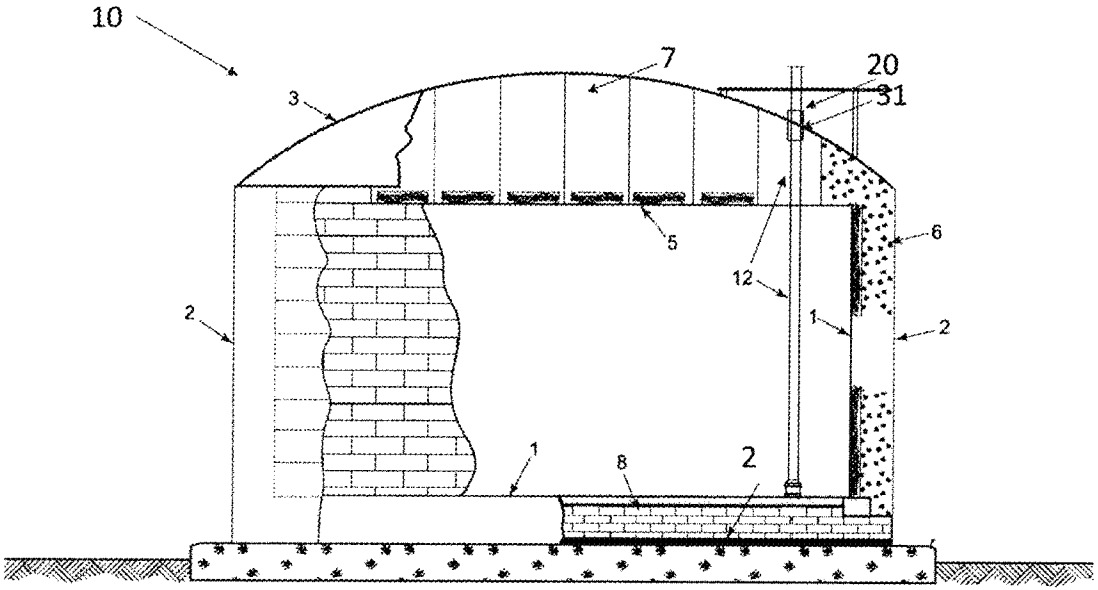
Figure 1 (Prior Art)
FIG. 1 is a partial cross-sectional view of a liquefied gas storage tank.

Although conventional TDP assembly 20 shown in FIG. 2 is prone to the formation of process ice, the welded connections between the roof 3 and the outer sleeve 23, as well as the welded connections between the outer sleeve 23 and the top plate 24 ensure that ambient moisture will not penetrate the insulation 21. As discussed above, ambient moisture penetrating insulation is undesirable as the moisture damages and renders the insulation ineffective.

In contrast, the TDP assembly of the present disclosure (for example, assembly 100 in FIGS. 3A and 3B) does not provide a welded barrier between the insulation and ambient conditions. Instead, the inventors of the TDP assembly 100 of the present disclosure have advantageously found that by locating the connection between the sleeve 101 of the TDP assembly 100 and the pipe 220 below the roof of the tank and using a primary vapor barrier 114, which has poor thermal conduction properties at second end 103, to prevent ambient moisture from entering insulation 110, improved thermal performance and prevention of ice formation along the TDP assembly may be achieved.

Embodiments disclosed herein may also provide for a safer and more economic installation of a TDP assembly. The pre-insulated TDP assembly may resist damage during transportation. Additionally, installation on-site may be more efficient, as the assembly no longer needs to be insulated on-site, thereby improving schedule, cost, and safety. Consequently, the quicker installation and safety may add flexibility as to when in the installation schedule the assembly may be installed. The location of the TDP along the pipe may also be adjusted during installation allowing for greater flexibility.

A storage tank in accordance with embodiments disclosed herein includes a tank roof and a tank sidewall. Either the tank roof or the tank sidewall includes at least one opening having a pipe extending therethrough. A sleeve assembly is located around the pipe and extends through the at least one opening. The sleeve assembly includes at least a sleeve coupled to the storage tank, at least one layer of insulation disposed in an annulus between the pipe and the sleeve, and an inner flange disposed on a first end of the sleeve and coupled to the pipe. The sleeve assembly is positioned such that the inner flange is disposed within the storage tank.

An assembly in accordance with embodiments disclosed herein includes at least a sleeve having a first end and a second end. An inner flange is positioned at the first end of the sleeve, connecting the pipe 220 and sleeve 101. The inner flange is positioned such that said inner flange and any insulation adjacent the inner flange is not exposed to ambient conditions. At least a first layer of insulation is positioned along an inner surface of the sleeve, such that the first layer of insulation extends from near the inner flange toward the second end of the sleeve.

A method in accordance with embodiments disclosed herein includes a method of manufacturing an assembly. The method of manufacturing includes at least forming a thermal distance piece having an annular flange on a first end of a sleeve. At least a first layer of insulation is installed along an inner length of the sleeve, between the flange and a second end of the sleeve. The first layer of insulation is installed prior to installing the thermal distance piece on a tank.

A method in accordance with embodiments disclosed herein includes installing a thermal distance piece assembly onto a pipe of a storage tank. The installation is performed by sliding a pipe having a thermal distance piece disposed thereon into an opening of a tank. The thermal distance piece is positioned in an opening of the tank, and at least a portion of the thermal distance piece is located inside the tank. Once in place a sleeve of the thermal distance piece is connected to the tank, for example, the sleeve of the thermal distance piece is welded to the roof of the tank.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A storage tank comprising:
- a tank roof;
- a tank sidewall;
- an opening in at least one of the tank roof or the tank sidewall;
- a pipe extending through the at least one opening; and
- a sleeve assembly disposed around the pipe and extending through the at least one opening,
  - the sleeve assembly including:
  - a sleeve coupled to the storage tank;
  - at least one layer of insulation disposed in an annulus between the pipe and the sleeve; and
  - an inner flange disposed on a first end of the sleeve, the inner flange having a surface contacting both the sleeve and the pipe, the inner flange disposed within the storage tank.

2. The storage tank of claim 1, further comprising an outer flange disposed on an outer diametric surface of the sleeve between the first end of the sleeve and a second end of the sleeve, wherein the outer flange couples the sleeve to the storage tank.

3. The storage tank of claim 1, wherein a connector sleeve is disposed within the perimeter of the opening and coupled to the tank, wherein the sleeve is attached to the connector sleeve.

4. The storage tank of claim 1, wherein the sleeve assembly further comprises a vapor barrier layer located at a second end of the sleeve, extending radially inward from the sleeve to the pipe.

5. The storage tank of claim 1, wherein the inner flange is not exposed to ambient conditions.

6. The storage tank of claim 1, wherein a second end of the sleeve disposed above the opening outside the storage tank is not directly coupled to the pipe.

7. An assembly comprising:

a section of pipe;

a sleeve having a first end and a second end disposed around the section of pipe;

an annular flange disposed at the first end of the sleeve extending radially inward and having a surface contacting both an outer surface of the section of pipe and the sleeve; and a first layer of insulation disposed along an inner surface of the sleeve extending from near the flange toward the second end, wherein the annular flange and any insulation adjacent the annular flange is not exposed to ambient conditions once installed in a tank.

8. The assembly of claim 7, further comprising a second layer of insulation disposed along a length of the inner surface of the first layer of insulation.

9. The assembly of claim 7, wherein the first layer of insulation is selected from a foam insulation and/or a blanket insulation.

10. The assembly of claim 7, further comprising a vapor barrier layer disposed at the second end of the sleeve extending from a surface of the sleeve to the outer surface of the section of pipe.

11. The assembly of claim 7, further comprising an outer flange extending radially outward from the sleeve and disposed between the first end and the second end of the sleeve.

12. An assembly comprising:

a sleeve having a first end and a second end;

an annular flange disposed at the first end of the sleeve extending radially inward and having a surface coupled to the first end of the sleeve; and a first layer of insulation disposed along an inner surface of the sleeve extending from near the flange toward the second end, wherein the annular flange and any insulation adjacent the annular flange is not exposed to ambient conditions once installed in a tank.

* * * * *